US008526854B2

(12) United States Patent
Kawahara

(10) Patent No.: US 8,526,854 B2
(45) Date of Patent: Sep. 3, 2013

(54) CLEANING BODY, CLEANING DEVICE, CHARGING DEVICE, ASSEMBLED BODY, AND IMAGE FORMING APPARATUS

(75) Inventor: Ichirou Kawahara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 196 days.

(21) Appl. No.: 13/042,889

(22) Filed: Mar. 8, 2011

(65) Prior Publication Data

US 2012/0076529 A1 Mar. 29, 2012

(30) Foreign Application Priority Data

Sep. 27, 2010 (JP) ..... 2010-215629

(51) Int. Cl.
*G03G 21/00* (2006.01)

(52) U.S. Cl.
USPC ..... 399/123

(58) Field of Classification Search
USPC ..... 399/100, 101, 357; 492/35, 43, 492/44; 15/256.5, 256.51, 256.52
IPC ..... G03G 15/02, 21/00
See application file for complete search history.

(56) References Cited

U.S. PATENT DOCUMENTS

| | | | | |
|---|---|---|---|---|
| 2,205,538 | A * | 6/1940 | Owen | 52/204.591 |
| 5,398,102 | A | 3/1995 | Wada et al. | |
| 6,928,252 | B2 * | 8/2005 | Takami et al. | 399/111 |
| 2004/0057747 | A1 * | 3/2004 | Michlin | 399/106 |
| 2006/0120779 | A1 * | 6/2006 | Uchihashi | 399/358 |
| 2008/0253817 | A1 * | 10/2008 | Sasagawa | 399/357 |

FOREIGN PATENT DOCUMENTS

| | | | |
|---|---|---|---|
| JP | 5-142920 | | 6/1993 |
| JP | 5-297686 | | 11/1993 |
| JP | 8-137208 | | 5/1996 |
| JP | 2002-91134 | | 3/2002 |
| JP | 2008-96822 | | 4/2008 |
| JP | 4118929 | B | 5/2008 |
| JP | 2008-145566 | | 6/2008 |
| JP | 2008-304729 | | 12/2008 |
| JP | 2008304729 | A * | 12/2008 |

* cited by examiner

*Primary Examiner* — Clayton E Laballe
*Assistant Examiner* — Victor Verbitsky
(74) *Attorney, Agent, or Firm* — Sughrue Mion, PLLC

(57) ABSTRACT

A cleaning body is provided including: a rotating axial member; an elastic layer, fixed to the axial member, contacting a body to be cleaned and cleaning the body to be cleaned; a held portion projecting out towards the axial member axial direction outside from an axial direction end portion of the elastic layer; a holding member provided at an axial direction end portion of the axial member and holding the held portion between the holding member and the axial member; and a cleaning portion including an incision formed in a width direction central portion of the end portion of the elastic layer, formed such that the incision is open by the held portion being held by the holding member, the cleaning portion contacting an end portion of the body to be cleaned and cleaning the end portion of the body to be cleaned.

18 Claims, 12 Drawing Sheets

CLEANING BODY, CLEANING DEVICE, CHARGING DEVICE, ASSEMBLED BODY, AND IMAGE FORMING APPARATUS

CROSS-REFERENCE TO RELATED APPLICATION

This application is based on and claims priority under 35 USC 119 from Japanese Patent Application No. 2010-215629 filed on Sep. 27, 2010.

BACKGROUND

1. Technical Field

The present invention relates to a cleaning body, a cleaning device, a charging device, an assembled body and an image forming apparatus.

2. Related Art

A cleaning device for a charging roll is known conventionally.

SUMMARY

A cleaning body according to a first aspect of the present invention includes: a rotating axial member; an elastic layer, fixed to the axial member, contacting a body to be cleaned and cleaning the body to be cleaned; a held portion projecting out towards the axial member axial direction outside from an axial direction end portion of the elastic layer; a holding member provided at an axial direction end portion of the axial member and holding the held portion between the holding member and the axial member; and a cleaning portion including an incision formed in a width direction central portion of the end portion of the elastic layer, formed such that the incision is open by the held portion being held by the holding member, the cleaning portion contacting an end portion of the body to be cleaned and cleaning the end portion of the body to be cleaned.

BRIEF DESCRIPTION OF THE DRAWINGS

Exemplary embodiments of the present invention will be described in detail based on the following figures, wherein.

DETAILED DESCRIPTION

Figure 1:
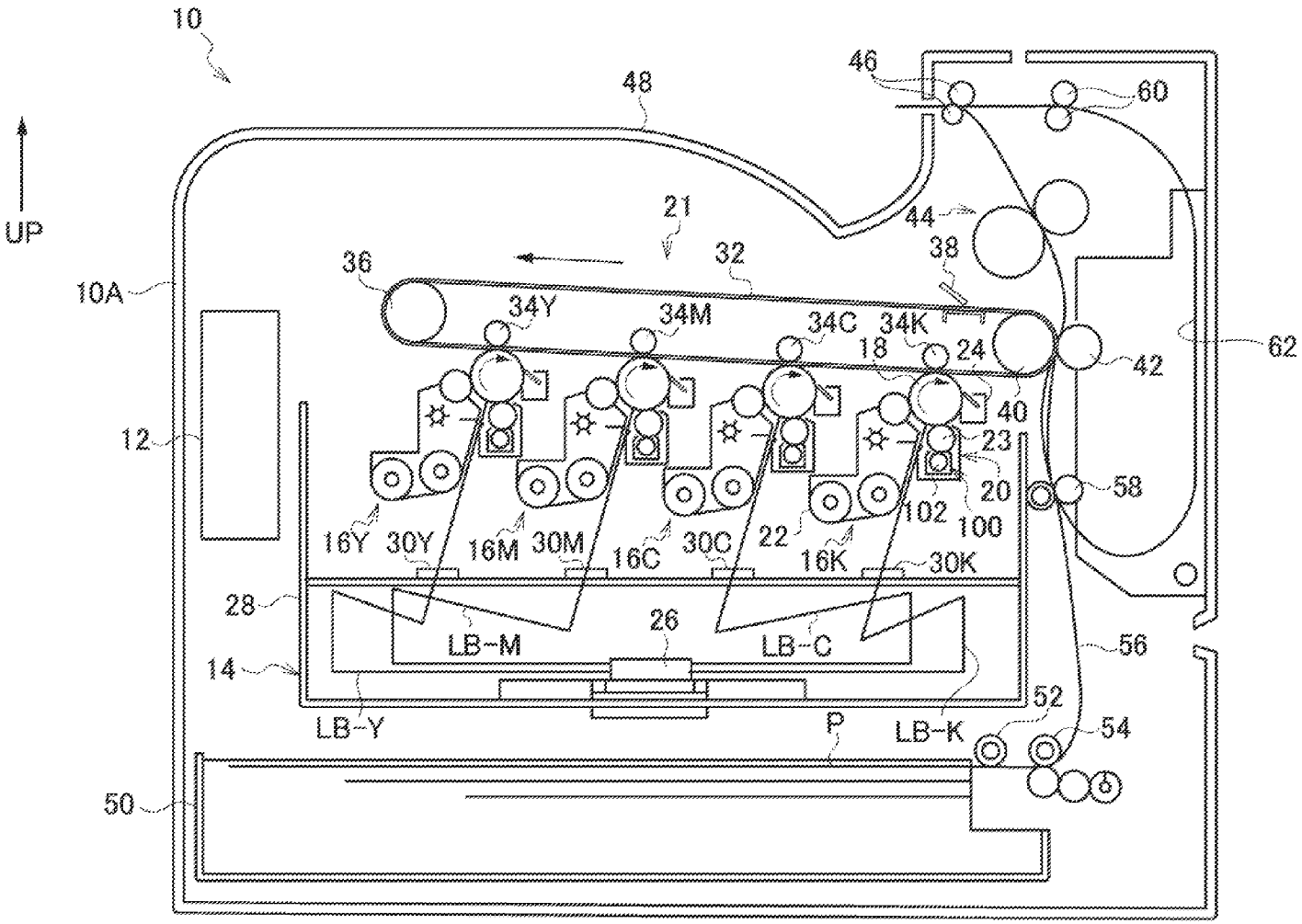
FIG. 1 is a schematic diagram showing a configuration of an image forming apparatus.

Detailed explanation follows regarding an exemplary embodiment of the present exemplary embodiment, with reference to the drawings. In FIG. 1, the direction of the top of an image forming apparatus 10 is shown by arrow UP. First a configuration of the image forming apparatus 10 will be explained. As shown in FIG. 1, an image processing section 12 is provided inside an apparatus main body 10A of the image forming apparatus 10 for performing image processing on input image data.

The image processing section 12 performs processing so as to convert the input image data into gradation data for four colors, yellow (Y), magenta (M), cyan (C), and black (K). An exposing device 14 is provided substantially at the center inside the apparatus main body 10A. The exposing device 14 receives the processed gradation data and performs image-wise light-exposure using laser beams LB.

Four image forming units 16Y, 16M, 16C, 16K, for yellow (Y), magenta (M), cyan (C), black (K), are disposed at intervals along the horizontal direction above the exposing device 14. Note that the suffixes Y, M, C, K are omitted below when differentiation between Y, M, C, K is not required in the explanation.

These four image forming units 16Y, 16M, 16C, 16K are of similar overall configuration to each other, and each include: a rotationally driven image holding body 18, serving as an example of a body to be charged of circular cylindrical shape; a charging device 20 that charges the outer peripheral face of the image holding body 18; a developing device 22 that develops electrostatic latent images, formed by image exposure light from the exposing device 14 on the outer peripheral face of the image holding body 18 charged by the charging device 20, with toner of the respective color to make the electrostatic latent images visible as toner images; and a cleaning section 24 for cleaning the outer peripheral face of the image holding body 18.

The image holding body 18 is configured capable of holding a formed image, and is specifically configured with a photoreceptor. The charging device 20 includes a charging roll 23, serving as an example of a charging body, for charging the outer peripheral face of the image holding body 18, and a cleaning device 100 for cleaning the charging roll 23.

The charging roll 23 is in contact with the outer peripheral face of the image holding body 18, rotates, and charges the outer peripheral face of the image holding body 18. The charging roll 23 also serves as an example of a body to be cleaned by the cleaning device 100. Specific details regarding configuration of the cleaning device 100 are given later.

Each of the image forming units 16Y, 16M, 16C, 16K are configured so as to be attachable and detachable to and from the apparatus main body 10A. The apparatus main body 10A is configured to function as an assembled body, assembled such so as to be attachable and detachable as a single unit to and from the apparatus main body 10A. Note that configuration may be made without the image forming units 16Y, 16M, 16C, 16K being unitized, such that, for example, they are supported on a common support frame, and the image forming units may be configured to be not attachable to or detachable from the apparatus main body 10A.

Four semiconductor lasers, not shown in the drawings, are provided in the exposing device 14, for the four image forming units 16Y, 16M, 16C, 16K, each of a common configuration. Configuration is made such that laser beams LB-Y, LB-M, LB-C, LB-K are emitted from the semiconductor lasers according to the respective gradation data.

Note these laser beams LB-Y, LB-M, LB-C, LB-K emitted from the semiconductor lasers are irradiated onto a polygon mirror 26, this being a rotatable multi-faceted mirror, through a f–θ lens, not shown in the figures, so as to be deflection-scanned by the polygon mirror 26. The laser beams LB-Y, LB-M, LB-C, LB-K that have been deflection-scanned by the polygon mirror 26 pass through a focusing lens and via plural mirrors, not shown in the drawings, so as to illuminate light exposure points onto the image holding bodies 18, diagonally from below.

The exposing device 14 is closely sealed by a casing 28 formed in a rectangular box shape around the periphery of the exposing device 14. Light transmitting members 30Y, 30M, 30C, 30K are provided in an upper portion of the casing 28, allowing the four laser beams LB-Y, LB-M, LB-C, LB-K to be transmitted through onto the image holding bodies 18 of each of the image forming units 16Y, 16M, 16C, 16K above.

A primary transfer unit 21 is provided above the image forming units 16Y, 16M, 16C, 16K. The primary transfer unit 21 includes: an endless shaped intermediate transfer belt 32; a drive roll 40, around which the intermediate transfer belt 32 is entrained, and rotationally driving the intermediate transfer belt 32 so as to circulate in the direction of the arrow shown in FIG. 1; a tensioning roll 36, around which the intermediate transfer belt 32 is entrained and imparting tension to the intermediate transfer belt 32; a cleaning section 38 that cleans the outer peripheral face of the intermediate transfer belt 32; and primary transfer rolls 34Y, 34M, 34C, 34K disposed at the opposite side of the intermediate transfer belt 32 to the side of the image holding bodies 18Y, 18M, 18C and 18K, with the intermediate transfer belt 32 interposed therebetween.

Toner images of each of the colors, yellow (Y), magenta (M), cyan (C), black (K) formed in sequence on the image holding bodies 18 of the image forming units 16Y, 16M, 16C, 16K, are transferred and superimposed onto the intermediate transfer belt 32 by the four primary transfer rolls 34Y, 34M, 34C, 34K.

A secondary transfer roll 42 is provided on the opposite side of the intermediate transfer belt 32 to that of the drive roll 40, with the intermediate transfer belt 32 interposed therebetween. The toner images, of each of the colors yellow (Y), magenta (M), cyan (C), and black (K) that have been transferred and superimposed onto the intermediate transfer belt 32, are conveyed by the intermediate transfer belt 32 to a secondary transfer position between the drive roll 40 and the secondary transfer roll 42, so as to be secondary transferred to a recording medium P that is being conveyed along a paper conveying path 56.

A fixing device 44 is further provided at the recording medium P conveying direction downstream side (referred to below simply as the "downstream side") relative to the secondary transfer roll 42. The fixing device 44 applies heat and pressure to the toner image transferred onto the recording medium P, thereby fixing the toner image to the recording medium P. Discharge rolls 46 are also provided at the downstream side of the fixing device 44, for discharging recording medium P to which the toner image has been fixed into a discharge section 48 provided at the top of the apparatus main body 10A of the image forming apparatus 10.

A housing section 50 housing the recording medium P is provided at the bottom side in the apparatus main body 10A of the image forming apparatus 10. A feed roll 52 is also provided for feeding out recording medium P housed in the housing section 50 along the paper conveying path 56. A separator roll 54 is provided at the downstream side of the feed roll 52, for separating and conveying the recording medium P one sheet at a time.

A positioning roll 58 is provided at the downstream side of the separator roll 54, for matching conveying timing. Accordingly, the recording medium P fed out from the housing section 50, is conveyed at a predetermined timing by the positioning roll 58 to the secondary transfer position where the intermediate transfer belt 32 and the secondary transfer roll 42 are in contact with each other.

Conveying rolls 60 are also provided adjacent to the discharge rolls 46, for conveying recording medium P, to which a toner image has been fixed on one side by the fixing device 44, onto a double-sided conveying path 62, without being discharged onto the discharge section 48 by the discharge rolls 46. The recording medium P conveyed along the double-sided conveying path 62, is re-conveyed to the positioning roll 58 in a front-back reversed state, such that this time a toner image is transferred and fixed to the back face of the recording medium P, with the recording medium P then being discharged onto the discharge section 48.

Images are formed on the recording medium P in the following manner with the image forming apparatus 10 configured as above. First gradation data for each of the colors is output in sequence from the image processing section 12 to the exposing device 14, laser beams LB-Y, LB-M, LB-C, LB-K emitted from the exposing device 14 according to the gradation data are scan-exposed onto the outer peripheral face of the image holding bodies 18 that have been charged by the charging devices 20 (the charging rolls 23), and electrostatic latent images are formed on the outer peripheral face of the image holding body 18.

The electrostatic latent images formed on the image holding bodies 18 are made visible as toner images of each of the respective colors, yellow (Y), magenta (M), cyan (C), and black (K), by the developing members 22Y, 22M, 22C, 22K.

The toner images of each of the colors yellow (Y), magenta (M), cyan (C), black (K) formed on the image holding bodies 18 are transferred and superimposed onto the circulating intermediate transfer belt 32 by the primary transfer rolls 34 of the primary transfer unit 21 disposed so as to span across above the image forming units 16Y, 16M, 16C, 16K.

The toner images of each of the colors that have been transferred and superimposed onto the circulating intermediate transfer belt 32 are then secondarily transferred by the secondary transfer roll 42 onto the recording medium P conveyed along the paper conveying path 56, from the housing section 50, by the feed roll 52, the separator roll 54, and the positioning roll 58.

Furthermore, the recording medium P to which the toner image has been transferred is conveyed towards the fixing device 44. The transferred toner image is fixed to the recording medium P by the fixing device 44. The recording medium P to which the toner image is fixed is then discharged by the discharge rolls 46 onto the discharge section 48 provided at the top of the apparatus main body 10A of the image forming apparatus 10.

Note that when images are to be formed on both sides of the recording medium P, the conveying direction of the recording medium P, to which an image has been fixed on one face by the fixing device 44, is switched, without being discharged onto the discharge section 48 by the discharge rolls 46, and the recording medium P is conveyed along the double-sided conveying path 62 through the conveying rolls 60.

By conveying the recording medium P along the double-sided conveying path 62, the recording medium P is reversed, and then re-conveyed to the positioning roll 58 with the front and back faces of the recording medium P reversed. This time, a toner image is transferred and fixed to the back face of the recording medium P, and then the sheet member P to which the toner image has been transferred and fixed is discharged onto the discharge section 48 by the discharge rolls 46.

Figure 2:
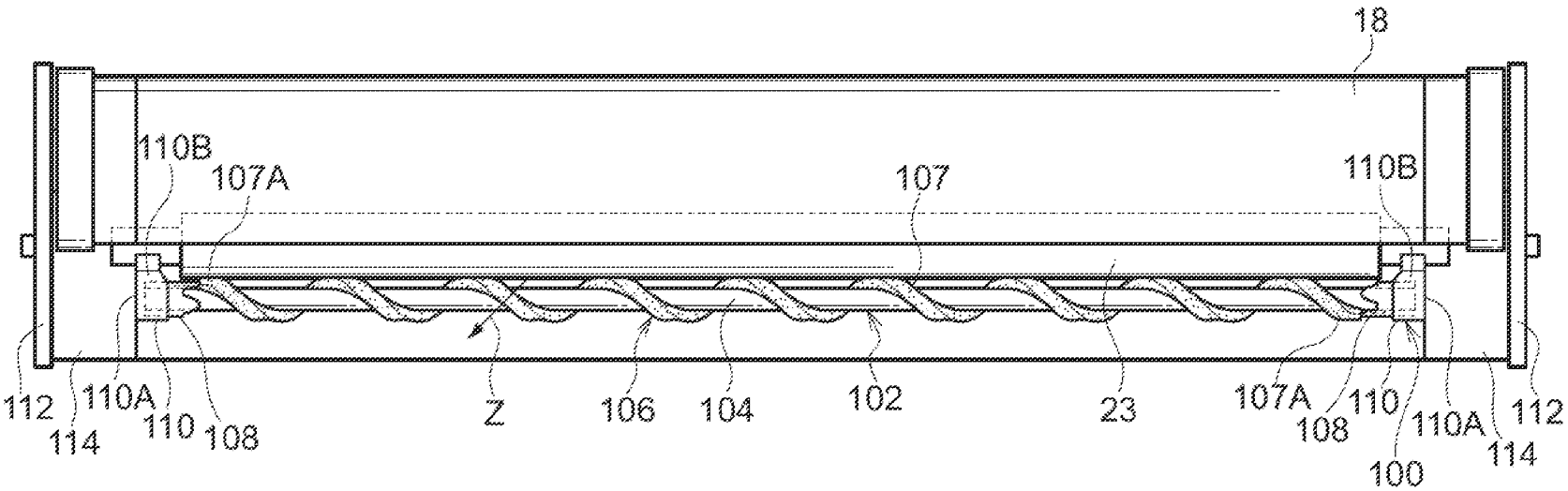
FIG. 2 is a schematic diagram showing a configuration of a cleaning device.
Figure 3:
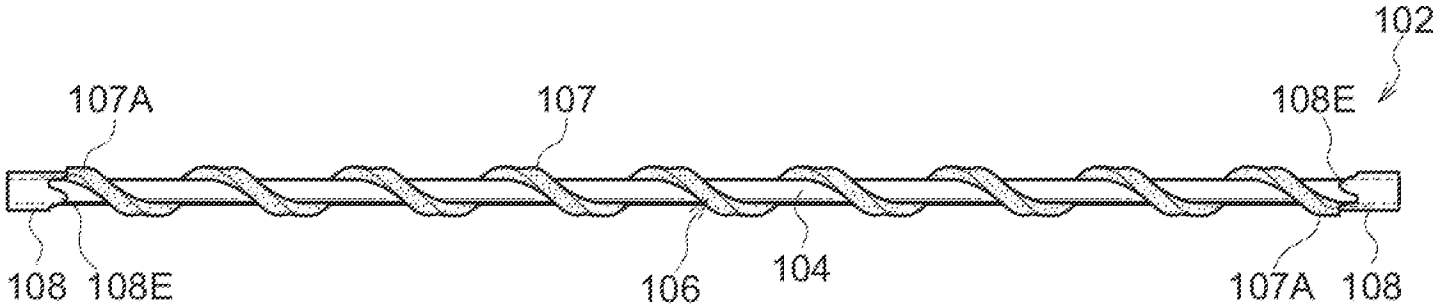
FIG. 3 is a schematic diagram showing a configuration of a cleaning body.

Detailed explanation now follows regarding the cleaning device 100 according to the present exemplary embodiment. As shown in FIG. 2 and FIG. 3, the cleaning device 100 is equipped with a cleaning body 102, for cleaning the charging roll 23 serving as an example of a body to be cleaned. The cleaning body 102 is equipped with an axial member 104 disposed along the axial direction of the charging roll 23, and a cleaning member 106 wound in a spiral onto the outer peripheral face of the axial member 104 and fixed by bonding.

Figure 4:
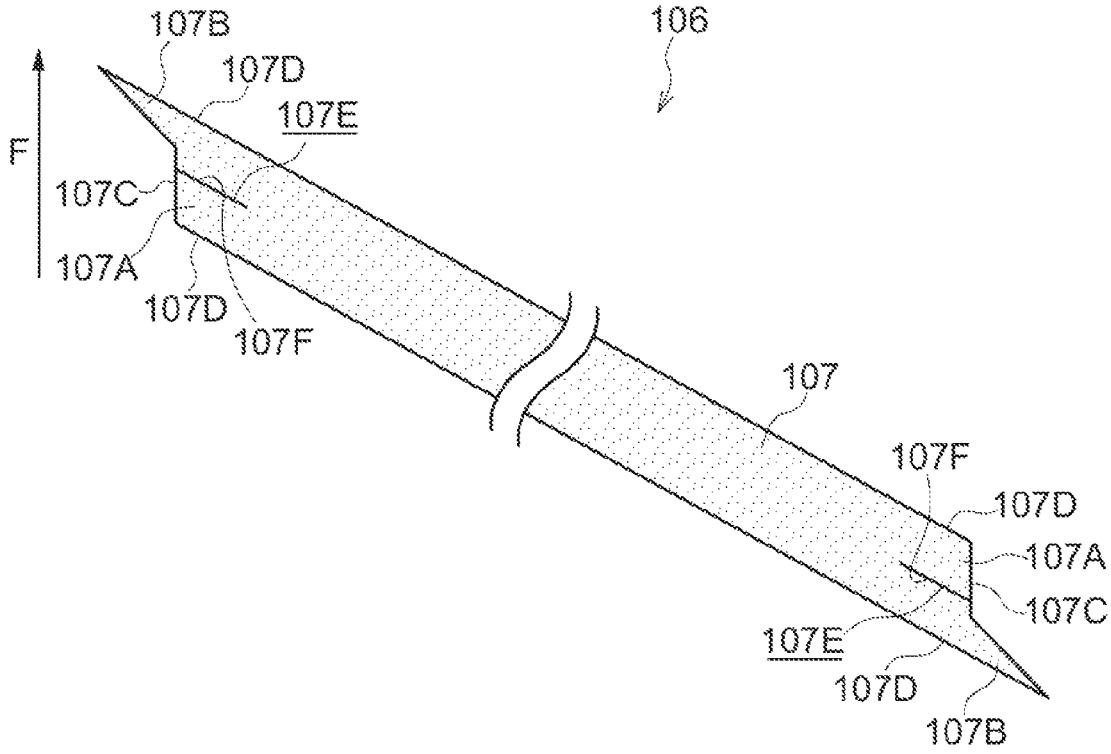
FIG. 4 is a plan view showing the shape of a projection portion connected to an end portion of a cleaning member and an incision.

The axial member 104 is formed from a metal material so as to extend along the axial direction of the charging roll 23, and is formed in a circular pillar shape, except for at its ends. The cleaning member 106, as shown in FIG. 4, is formed in a strip shape (long thin shape with a substantially parallelogram cross-section) and is configured with a elastically deformable elastic layer 107, and a bonding layer 105 (see FIG. 6), bonded by its back face to the axial member 104 with the elastic layer 107 bonded to its entire front face.

The bonding layer 105 is configured, for example, from a bonding material, such as an adhesive, double-sided adhesive tape or the like. The cleaning member 106 is attached (fixed) by the bonding layer 105 to the outer peripheral face of the axial member 104 from one axial direction end of the cleaning member 106 across to the other axial direction end. Note that while the bonding layer 105 here is a single-layered bonding layer, a multi-layered bonding layer may be employed. When the bonding layer 105 is configured with a multi-layered bonding layer, non-bonding layer(s) may be interposed between bonding layers, such as a electrically conducting layer, a non-electrically conducting layer, a semiconducting layer, a heat insulating layer, a heat transmitting layer, or the like.

The elastic layer 107 is, for example, configured by a poly-urethane resin foam (sponge) or the like. As shown in FIG. 4, projection portions 107B, serving as examples of held portions, project out at two length direction end portions 107A of the elastic layer 107 towards the axial member 104 axial direction outside when the elastic layer 107 is wound onto the axial member 104. The end portions 107A and the projection portion 107B are integrally connected together. In following explanation reference to the end portions 107A is defined not to include the projection portions 107B.

Each of the projection portions 107B is a portion held by a later described holding member 108 (is a portion sandwiched between the holding member 108 and the axial member 104), and projects out, for example, in a long thin triangular shape from a width direction portion of the elastic layer 107, in order to minimize the area required to be held by the holding member 108.

Namely, as shown in FIG. 4, the projection portion 107B at a first end side (the left hand side in the drawing) of the cleaning member 106 (the elastic layer 107) is provided so as to be connected to the end portion 107A at the axial member 104 rotation direction downstream side (shown by the arrow F). The projection portion 107B at a second end side (the right hand side in the drawing) of cleaning member 106 (of the elastic layer 107) is provided so as to be connected to the end portion 107A at the axial member 104 rotation direction upstream side. Namely, the cleaning member 106 (the elastic layer 107) shown in FIG. 4 is formed in a shape having symmetry about a point.

Figure 5:
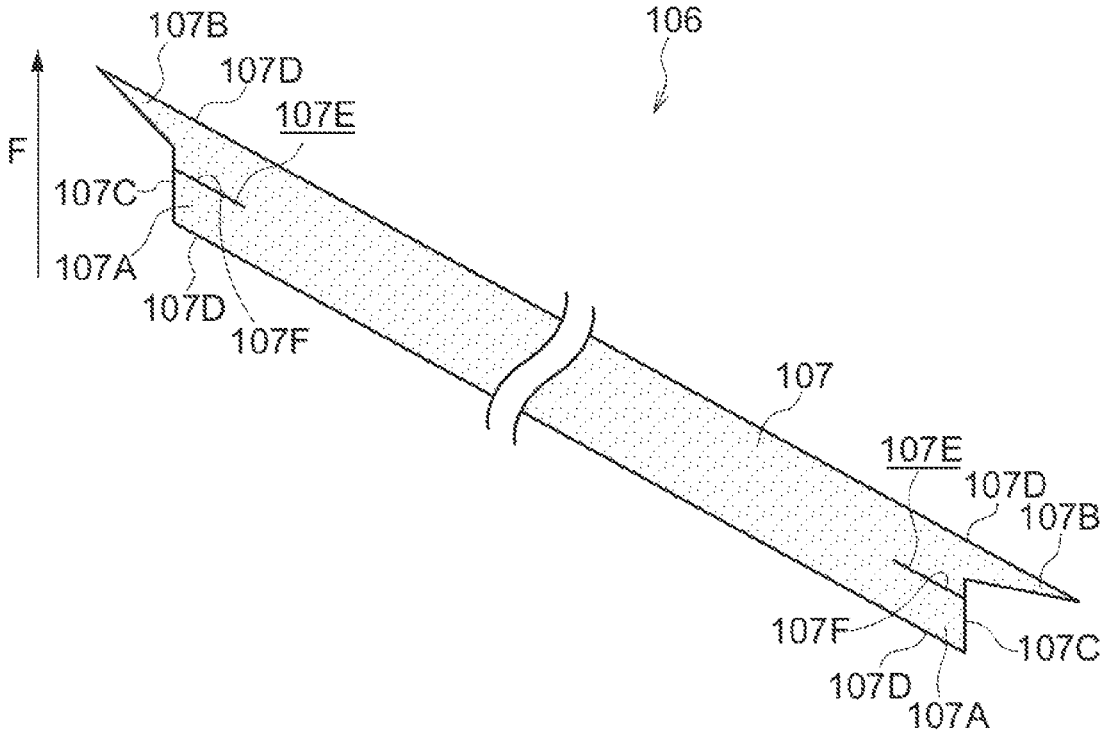
FIG. 5 is a plan view showing the shape of a projection portion connected to an end portion of a cleaning member and an incision.

Note that the cleaning member 106 (the elastic layer 107) may be formed in the shape shown in FIG. 5. Namely, the projection portion 107B at the second end side (right hand side in the drawing) of the cleaning member 106 (of the elastic layer 107) may be provided connected to the end portions 107A at the axial member 104 rotation direction downstream side. In such a case, since the projection portions 107B are connected at the axial member 104 rotation direction downstream side at both the first end side and the second end side of the cleaning member 106 (the elastic layer 107), the end portions 107A are not susceptible to being peeled off from the axial member 104 during cleaning of the charging roll 23.

Figure 6:
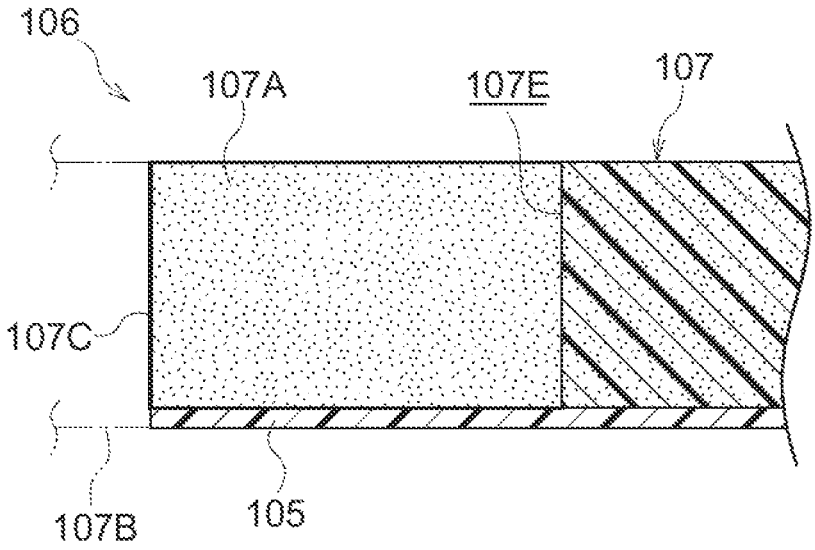
FIG. 6 is a cross-section showing a configuration of an end portion of a cleaning member.

Furthermore, as shown in FIG. 4 to FIG. 6, incisions 107E are formed with a predetermined length (for example, about twice the projection height of claw portions 108E, described below) extending from the edge portion of the end portions 107A substantially along the extending direction (substantially parallel to the extending direction) of the cleaning member 106 (the elastic layer 107) at a width direction central portion of the end portions 107A of the cleaning member 106 (of the elastic layer 107). The incisions 107E are configured so as to open when the holding member 108, described below, holds the projection portion 107B.

The incisions 107E are formed substantially along the extending direction (length direction) of the elastic layer 107. Accordingly, there is a degree of freedom for setting the length of the incisions 107E, in contrast, for example, to cases where the incisions 107E are inclined with respect to the elastic layer 107 extending direction, concentration of stress at the terminal portion of the incisions 107E is relieved, thereby suppressing or preventing rupturing (tearing off) of the end portions 107A of the elastic layer 107.

Furthermore, while not shown in the drawings, the elastic layer 107 is prevented from splitting along the incisions 107E by forming circular shaped holes at the terminal portions of the incisions 107E. Furthermore, the incisions 107E, as shown in FIG. 6, are only formed through the elastic layer 107, and are formed so as not to continue through to the bonding layer 105. Accordingly a configuration is achieved in which the end portions 107A are not susceptible to being peeled off from the axial member 104.

Configuration is such that each of the projection portions 107B is connected to a width direction portion of the elastic layer 107 at the end portion 107A of the elastic layer 107 (the cleaning member 106), and only the projection portion 107B itself is held by the holding member 108. Accordingly, the end portion 107A to which the projection portion 107B is connected is not held by the holding member 108 (not covered thereby), and is externally exposed. The incisions 107E are open.

Consequently, as shown in FIG. 4, FIG. 5, and FIG. 8 to FIGS. 10A, 10B, a first ridge line portion 107C, serving as an example of a cleaning portion along the circumferential direction of the axial member 104, and a second ridge line portion 107D, serving as an example of a cleaning portion along a direction intersecting with the circumferential direction, are formed to each of the end portions 107A that reach the edge of the holding member 108 (including the claw portion 108E, described later). Third ridge portions 107F, also serving as examples of cleaning portions, are also formed substantially parallel to the second ridge line portion 107D at the edges of each of the incisions 107E (and in particular at the edge portion on the side not connected to the projection portion 107B).

Due to forming the first ridge line portion 107C, the second ridge line portion 107D and the third ridge portions 107F, the thickness of the elastic layer 107 (particularly the thickness of the elastic layer excluding the side connected to the projection portion 107B), namely the height of projection portions 106A, described later, is consistently maintained at the same height from one end to the other of the elastic layer 107, in a configuration that enhances the ability to clean the two axial direction end portions of the charging roll 23.

Figure 11:
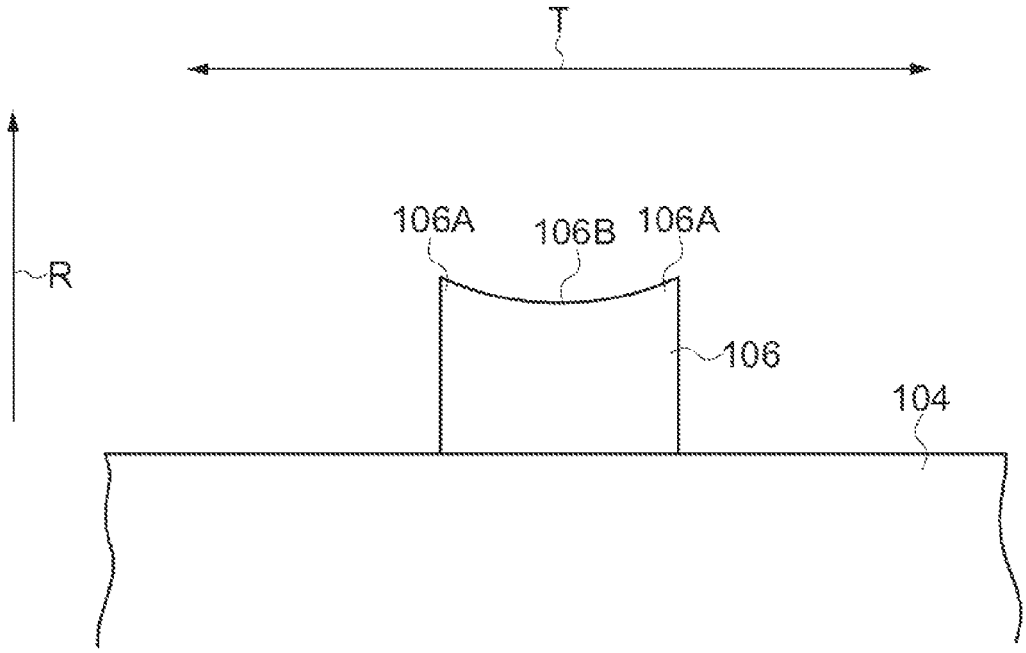
FIG. 11 is schematic diagram showing a portion of a cross-section of a cleaning body taken along an axial member axial direction.

Namely, the cleaning member 106, as shown in FIG. 11, has a substantially quadrangular shape surrounded by 4 sides (including a curved line) in cross-section along axial direction T of the axial member 104, with projection portions 106A projecting out towards the radial direction outside (the arrow R direction in FIG. 11) at both ends of the cleaning member 106 in the axial member 104 axial direction T. The projection portions 106A are, for example, formed by applying tension to the cleaning member 106, to generate a difference in external radius of the outer peripheral face of the cleaning member 106 (the top face in FIG. 11) along the axial direction T between the external radius at the projection portions 106A and at the central portion 106B.

The cleaning member 106 is similarly formed with a substantially quadrangular shape surrounded by 4 sides (including a curved line) in cross-section along a direction (the arrow Z direction in FIG. 2) orthogonal to the winding direction, with the projection portions 106A projecting out towards the radial direction outside (the arrow R direction in FIG. 11) at the two axial direction T end portions of the cleaning member 106. In the cleaning body 102, the outer peripheral face of the cleaning member 106 (the top face in FIG. 11) including the projection portions 106A contacts the charging roll 23, such that the axial member 104 follows the rotation of the charging roll 23.

Consequently, as the outer peripheral face of the cleaning member 106 sweeps across the outer peripheral face of the charging roll 23, the projection portions 106A of the cleaning member 106 scrape off foreign matter, and the foreign matter is removed from the outer peripheral face of the charging roll 23. At the two axial direction end portions of the charging roll 23 too, foreign matter remaining on the outer peripheral face at the two axial direction end portions of the charging roll 23 is scraped off and removed by the first ridge line portion 107C, the second ridge line portion 107D (the projection portions 106A) and the third ridge portions 107F (the projection portions 106A).

Figure 7:
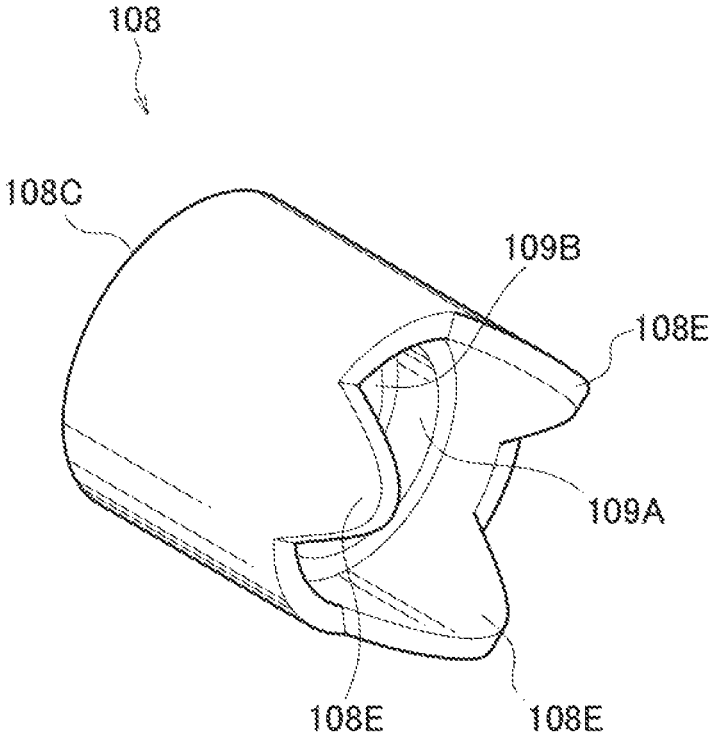
FIG. 7 is a perspective view showing a configuration of a holding member equipped with claw portions.
Figure 8:
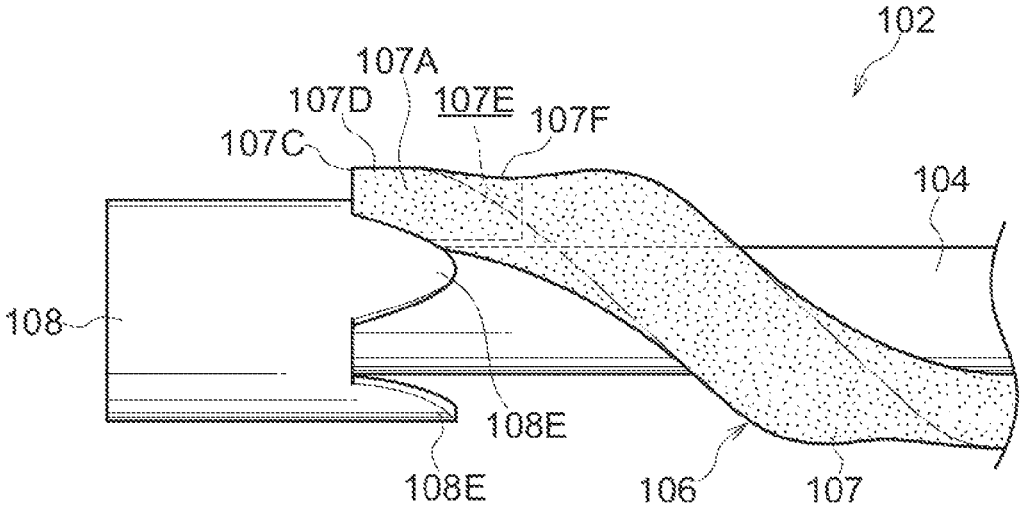
FIG. 8 is a schematic diagram showing a configuration of an end portion of a cleaning body.
Figure 9:
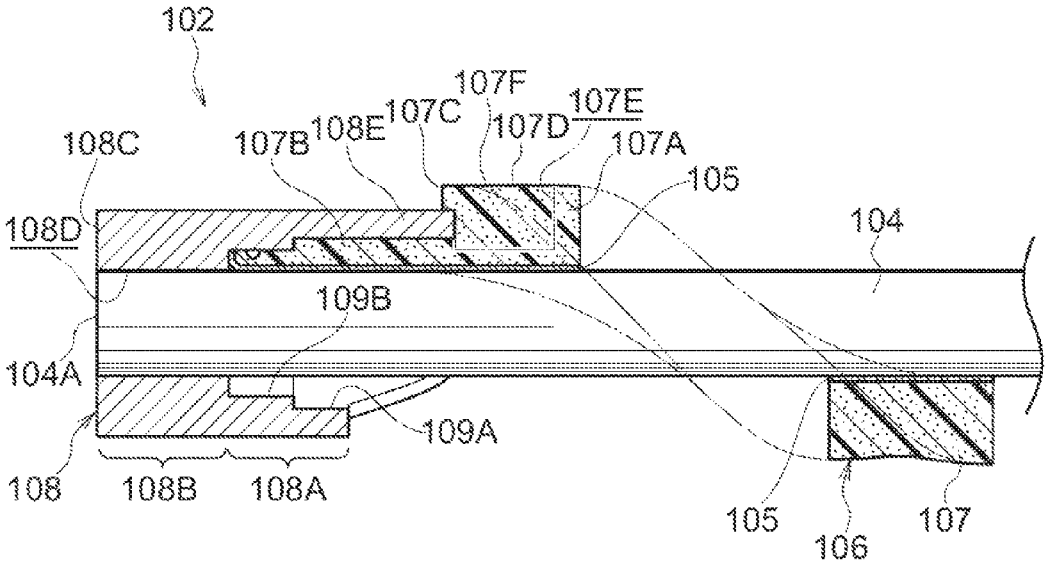
FIG. 9 is cross-section showing a configuration of an end portion of a cleaning body.

As shown in FIG. 7 to FIG. 9, the projection portions 107B that are connected to the end portions 107A of the elastic layer 107 at the two axial direction end portions of the axial member 104 are sandwiched between the axial member 104 and the respective circular cylindrical shaped holding member 108 (are held such that the projection portions 107B are not peeled off from the axial member 104).

The inner peripheral face of each of the holding members 108 is integrally formed with, in sequence from the axial direction inside to towards the outside, a circular cylindrical portion 108A formed with a gap with respect to the outer peripheral face of the axial member 104, and a retaining portion 108B that retains the inserted axial member 104. Namely, an insertion hole 108D is formed in the retaining portion 108B for insertion of the axial member 104.

The two end portions of the axial member 104 inserted into the retaining portions 108B and the insertion hole 108D are, for example, formed with a cross-section profile to prevent rotation, such as a D-cut or the like. By inserting two end portions of the axial member 104 into the insertion holes 108D, the retaining portions 108B retain the axial member 104, and the holding member 108 and the axial member 104 rotate as a single unit.

The retaining portion 108B of the drawings is shown retaining the axial member 104 such that the end face 108C of the retaining portion 108B is positioned on the same plane as an end face 104A of the axial member 104. However, the end face 104A of the axial member 104 may be positioned further to the axial direction inside (the right hand side in FIG. 9) than the end face 108C of the retaining portion 108B.

The circular cylindrical portion 108A is formed along the circumferential direction of the axial member 104, and is disposed, in sequence from the axial direction inside towards the outside, with a first internal diameter portion 109A and a second internal diameter portion 109B of smaller internal diameter than the first internal diameter portion 109A. By making the internal diameter of the first internal diameter portion 109A and the second internal diameter portion 109B different from each other, a step is formed between the first internal diameter portion 109A and the second internal diameter portion 109B.

The second internal diameter portion 109B sandwiches the projection portion 107B of the elastic layer 107 and the bonding layer 105 that slightly wraps around the projection portion 107B between itself and the outer peripheral face of the axial member 104, compressing and holding the bonding layer 105 and the projection portion 107B against the outer peripheral face of the axial member 104.

The first internal diameter portion 109A sandwiches the projection portion 107B of the elastic layer 107 and the bonding layer 105 between itself and the outer peripheral face of the axial member 104, compressing and holding the projection portion 107B and the bonding layer 105 against the outer peripheral face of the axial member 104. The first internal diameter portion 109A and the second internal diameter portion 109B thus function as holding portions that hold the projection portion 107B and the bonding layer 105 against the axial member 104.

In the present exemplary embodiment, explanation has been given of a case in which the second internal diameter portion 109B sandwiches the projection portion 107B and the bonding layer 105 that slightly wraps around the projection portion 107B between itself and the outer peripheral face of the axial member 104. However, there is no limitation thereto and, for example, when each of the holding members 108 is mounted to the axial member 104, the bonding layer 105 may be pressed and peeled so that the projection portion 107B is nipped between the second internal diameter portion 109B and the axial member 104 in a concertina shape or the like.

The cleaning member 106 is first bonded to the axial member 104 by the bonding layer 105, then the end portions of the axial member 104 are inserted into the insertion holes 108D of the retaining portions 108B so as to mount the holding members 108 on the axial member 104. The bonding layer 105 is thereby pressed and peeled by the edge portion of the insertion hole 108D of each of the retaining portions 108B, and this portion of the bonding layer 105 adheres to the inner peripheral face of the second internal diameter portion 109B.

The two end portions of the cleaning member 106 are thereby rendered even less susceptible to peeling off from the axial member 104.

Furthermore, as shown in FIG. 7, an edge portion of each of the holding members 108 is formed with three of the claw portions 108E at uniform intervals in the circumferential direction, serving as examples of projection portions projecting out towards the axial member 104 axial direction inside. These claw portions 108E are each formed in substantially an equilateral triangle shape, digging into the end face of each of the end portions 107A of the elastic layer 107 during mounting the holding members 108 to the axial member 104, and retaining the incisions 107E in an opened state.

Consequently, the end portions 107A of the elastic layer 107, and in particular the second ridge line portion 107D and the third ridge portions 107F are supported by the claw portion 108E, are not externally covered, and the first ridge line portion 107C is externally exposed from between claw portions 108E. Accordingly, the profile of the first ridge line portion 107C, the second ridge line portion 107D and the third ridge portions 107F is secured (achieving a configuration that contacts the outer peripheral face of the charging roll 23).

In the present exemplary embodiment, "digging into" refers not only to states in which a hole is opened in the end face of the end portions 107A, but also includes states where there is pressing against and elastically deforming the end face of the end portions 107A. Due to the claw portions 108E digging into the end face of the end portions 107A, the two end portions of the cleaning member 106 are made even less susceptible to being peeled off from the axial member 104.

In the cleaning device 100, as shown in FIG. 2, a pair of support members 110 is provided for rotatably supporting the holding members 108. More precisely, each of the support member 110 is provided with a substantially circular cylindrical shaped hollow portion 110B that is open towards the axial member 104 axial direction inside, and has a side wall 110A closing off the axial direction outside. The pressing members 108 are each capable of rotation as a single unit with the axial member 104 in the circumferential direction of the inner wall of the hollow portion 110B, while sliding against the inner wall of the hollow portion 110B.

The pair of support members 110 are fixed to fixing portions 114 formed to side plates 112 at the two sides of the support members 110. Note that in the charging roll 23 according to the present exemplary embodiment, axial direction end portions of the image holding body 18 are rotatably supported by the support members 110, such that the axial direction end portions of the image holding body 18 are rotatably supported by the side plates 112.

Explanation now follows regarding operation of the cleaning device configured as described above. Foreign matter, such as developer and the like, not transferred onto the intermediate transfer belt 32, and remaining on the outer peripheral face of the image holding body 18, is removed from the image holding body 18 by the cleaning section 24.

When this is performed, out of the developer components, foreign matter having relatively small particle diameters, such as additives and the like, slips under the cleaning section 24. Foreign matter such as additives that has passed under the cleaning section 24 adheres to the outer peripheral face of the charging roll 23.

The foreign matter adhered to the outer peripheral face of the charging roll 23 is removed by the outer peripheral face (the top face in FIG. 11) of the cleaning member 106, including the projection portions 106A, contacting the charging roll 23. Namely, at the outer peripheral face of the cleaning member 106, the projection portions 106A of the cleaning member 106 scrape off the foreign matter adhered to the outer peripheral face of the charging roll 23 by sweeping along the outer peripheral face.

Figure 12A:
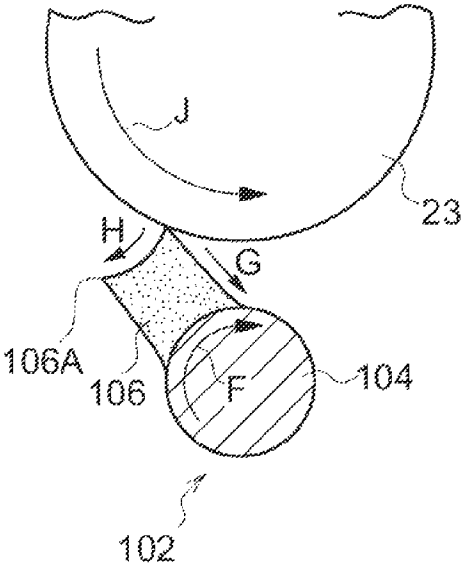
FIG. 12A is an explanatory diagram showing a cleaning operation of a cleaning body.
Figure 12B:
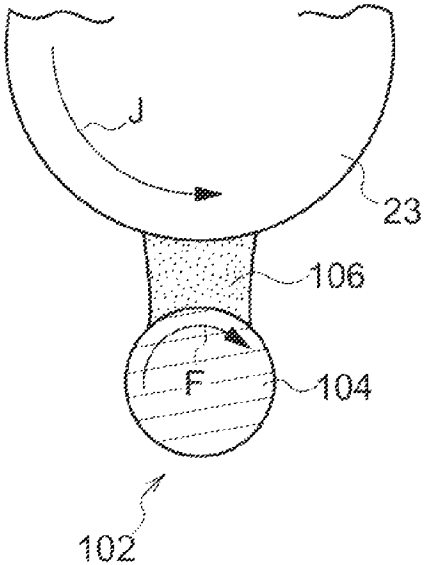
FIG. 12B is an explanatory diagram showing a cleaning operation of a cleaning body.

More precisely, as shown in FIG. 12A and FIG. 12B, at the cleaning member 106 of the cleaning body 102 that performs rotation following the charging roll 23 rotating in the arrow J direction, the projection portions 106A of the cleaning member 106 are pressed by the outer peripheral face of the charging roll 23 and elastically deform (elastically compress) in the cleaning member 106 height direction (the arrow G direction in FIG. 12A) and in the width direction (the arrow H direction in FIG. 12A).

Figure 12C:
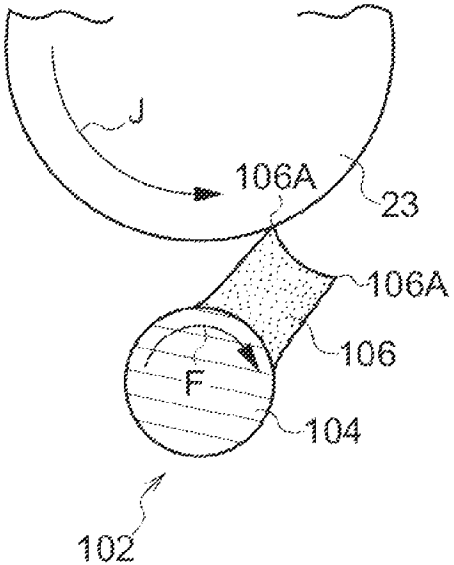
FIG. 12C is an explanatory diagram showing a cleaning operation of a cleaning body.

Accordingly, the foreign matter such as additives adhered to the outer peripheral face of the charging roll 23 is pressed by the projection portions 106A and aggregated together. Then, as shown in FIG. 12C the compacted state, due to reaction force from the projection portions 106A, of the aggregated foreign matter such as additives is released, and the foreign matter is thrown off from the outer peripheral face of the charging roll 23.

Figure 10A:
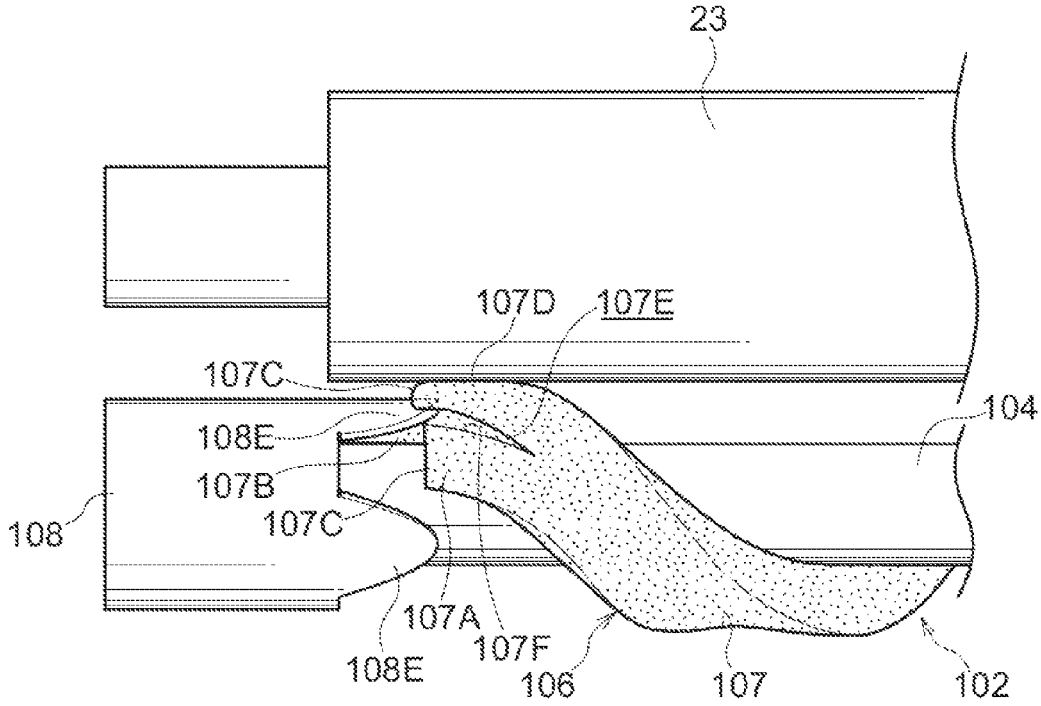
FIG. 10A is a schematic diagram showing a profile of an end portion of a cleaning body according to a present exemplary embodiment.

In the cleaning body 102 according to the present exemplary embodiment, as shown in FIG. 9 and FIG. 10A, the projection portion 107B alone is held by the holding member 108. The holding members 108 are mounted to the axial member 104 with the claw portions 108E digging into the end faces of the end portions 107A of the elastic layer 107, maintaining the incisions 107E in an opened state.

Consequently, in the elastic layer 107 of the cleaning member 106, the end portions 107A where the projection portions 107B are connected are not covered by the holding members 108 (including the claw portions 108E). At each of the end portions 107A are secured the first ridge line portion 107C in the circumferential direction, the second ridge line portion 107D (the projection portion 106A) in a direction intersecting with the circumferential direction, the third ridge portions 107F (the projection portions 106A) substantially parallel to the second ridge line portion 107D. Accordingly, capability to clean the two axial direction end portions of the charging roll 23 is enhanced.

Figure 10B:
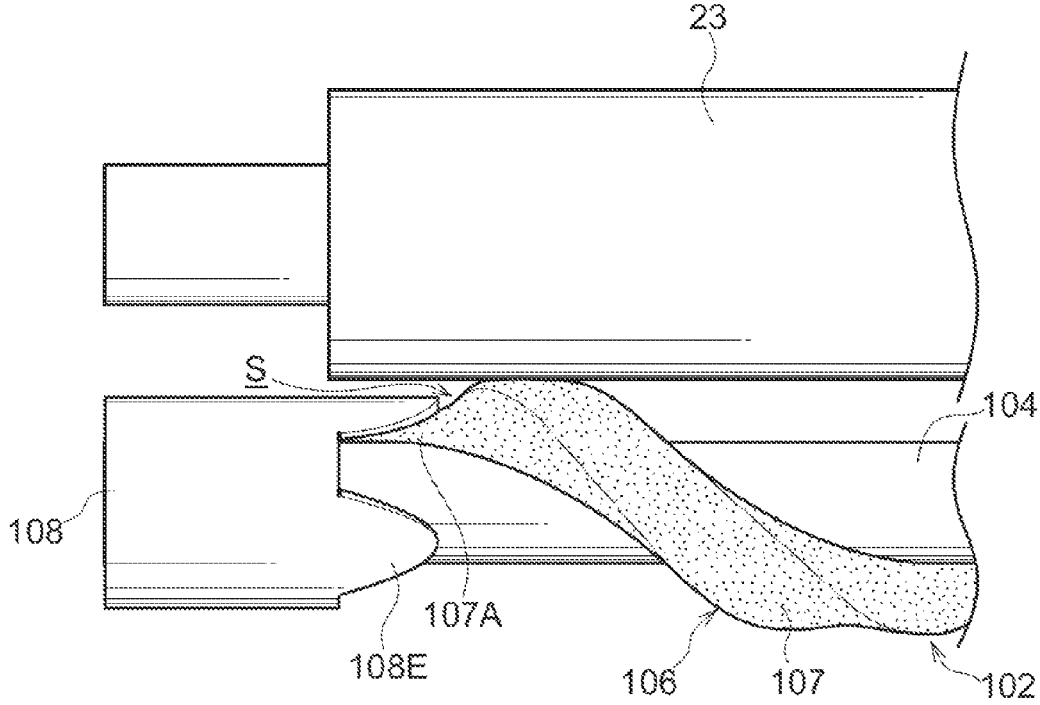
FIG. 10B is a schematic diagram showing a profile of an end portion of a cleaning body according to a comparative example.

Namely, as shown in FIG. 10B, in a cleaning body 102 of a comparative example in which there is a held portion, held by a first internal diameter portion 109A or a claw portion 108E of a holding member 108, formed across the entire width direction of end portions 107A of the elastic layer 107, the ridge portion (projection portion 106A) at the end portions 107A of the elastic layer 107 is covered by either the first internal diameter portion 109A or the claw portion 108E of the holding member 108.

Consequently, the ridge portion (the projection portion 106A) cannot be secured at the end portions 107A, and at the end portions 107A the profile adopted is one in which the pressure deforming the end portions 107A becomes weaker on progression towards the axial member 104 axial direction inside, namely, a profile is formed with a gap S to the outer peripheral face of the charging roll 23.

Accordingly, the region of the elastic layer 107 making contact with the two axial direction end portions of the charging roll 23 is decreased, with accompanying degradation to the capability to clean the two axial direction end portions (defective cleaning occurs). In order to secure cleaning ability, the axial direction length of the elastic layer 107 must be set longer, leading to the image forming apparatus 10 overall becoming bigger in the axial direction.

However, with the cleaning body 102 according to the present exemplary embodiment, as shown in FIG. 10A, the end portions 107A of the elastic layer 107 are not held by the holding member 108, and only the projection portion 107B connected to the end portions 107A is held by the holding member 108. Accordingly, the first ridge line portion 107C, the second ridge line portion 107D (the projection portion 106A), and the third ridge portions 107F (the projection portions 106A) of the end portions 107A of the elastic layer 107 are exposed between the claw portions 108E, and are not elastically deformed by the holding member 108 (including the claw portions 108E).

However, the claw portions 108E of the holding member 108 dig into the end face of the end portions 107A of the elastic layer 107, and a configuration is adopted in which the incisions 107E are maintained in an open state. Accordingly, the end portions 107A of the elastic layer 107 are supported by the claw portions 108E. However, the externally exposed first ridge line portion 107C, the second ridge line portion 107D, and the third ridge portions 107F are widely secured, and a wide region is secured of the elastic layer 107 to make contact with the two axial direction end portions of the charging roll 23.

Namely, each of the projection portions 107B is held by the holding member 108, and so even if, for example, the end portion 107A on the side connected to the projection portion 107B is elastically deformed, there is less variation in the thickness of the end portion 107A at the side on the opposite side of the incision 107E, not connected to the projection portion 107B. Accordingly, the image forming apparatus 10 is not increased in size in comparison to with the cleaning body 102 of the above comparative example, and yet good contact is achieved of the end portions 107A with the end portions of the charging roll 23. Consequently, equivalent cleaning ability is obtained for cleaning the two axial direction end portions of the charging roll 23 at the end portions 107A of the elastic layer 107 to that of the axial direction central portion of the elastic layer 107.

Explanation has been given of the cleaning body 102 according to the present exemplary embodiment based on the exemplary embodiment illustrated in the drawings. However, the cleaning body 102 according to the present exemplary embodiment is not limited to the exemplary embodiment illustrated, and various changes, modifications and improvements are possible. For example, configuration may be made in which the axial member 104 protrudes out from the end faces 108C of the retaining portions 108B, and it is the axial member 104 that is rotatably supported rather than the holding members 108. Note that the axial bearing may be configured as a rolling bearing and may be configured as a sliding bearing.

Furthermore, the elastic layer 107 is not limited to being wrapped in a spiral shape, and similar application may be made to other shapes, as long as a shape is formed in a circular cylindrical shape for inserting the axial member 104, and the incisions 107E are formed at axial direction end portions thereof. Furthermore, the illustrated holding members 108 are mounted to the two axial direction end portions of the axial member 104, however, depending on the configuration of the cleaning body 102, configuration may be made with one of the holding members 108 mounted only at one of the axial direction end portions of the axial member 104. Namely, configuration may be made with one of the holding members 108 provided at least one of the axial direction end portions of the axial member 104.

What is claimed is:

1. A cleaning body comprising:

a rotating axial member;

an elastic layer, fixed to the rotating axial member, contacting a body to be cleaned and cleaning the body to be cleaned;

a held portion projecting out towards the rotating axial member axial direction outside from an axial direction end portion of the elastic layer;

a holding member provided at an axial direction end portion of the rotating axial member and holding the held portion between the holding member and the rotating axial member; and a cleaning portion comprising an incision formed in a width direction central portion of the end portion of the elastic layer, formed such that the incision is kept open by the held portion being held by the holding member, the cleaning portion contacting an end portion of the body to be cleaned and cleaning the end portion of the body to be cleaned, and wherein the holding member deforms the held portion in a direction such that the held portion is compressed between the holding member and the rotating axial member, and wherein the held portion is disposed adjacent to the cleaning portion in a circumferential direction of the cleaning portion.

2. A cleaning body comprising:

a rotating axial member;

an elastic layer, fixed to the rotating axial member, contacting a body to be cleaned and cleaning the body to be cleaned;

a held portion projecting out towards the rotating axial member axial direction outside from a portion of the width direction of the elastic layer at an axial direction end portion of the elastic layer;

a holding member provided at an axial direction end portion of the rotating axial member and holding the held portion between the holding member and the rotating axial member; and an incision, formed in a width direction central portion of the end portion of the elastic layer from which the held portion projects, and formed such that the incision is kept open by the held portion being held by the holding member, and wherein the holding member deforms the held portion in a direction such that the held portion is compressed between the holding member and the rotating axial member, and wherein the held portion disposed adjacent to the incision in a circumferential direction of the incision.

3. The cleaning body of claim 1, wherein the elastic layer is wound in a spiral shape onto the rotating axial member.

4. The cleaning body of claim 2, wherein the elastic layer is wound in a spiral shape onto the rotating axial member.

5. The cleaning body of claim 1, wherein the elastic layer is bonded to the rotating axial member by an adhesive layer, and the incision is not formed in the adhesive layer.

6. The cleaning body of claim 2, wherein the elastic layer is bonded to the rotating axial member by an adhesive layer, and the incision is not formed in the adhesive layer.

7. The cleaning body of claim 1, wherein the incision is formed substantially parallel to the extending direction of the elastic layer.

8. The cleaning body of claim 2, wherein the incision is formed substantially parallel to the extending direction of the elastic layer.

9. A cleaning device comprising:

the cleaning body of claim 1 that makes contact with the body to be cleaned that is rotating, and cleans the body to be cleaned while following the rotation of the body to be cleaned; and a support member that rotatably supports the holding member.

10. A cleaning device comprising:

the cleaning body of claim 2 that makes contact with the body to be cleaned that is rotating, and cleans the body to be cleaned while following the rotation of the body to be cleaned; and a support member that rotatably supports the holding member.

11. A charging device comprising:

the cleaning device of claim 9; and a rotating charging body as the body to be cleaned.

12. A charging device comprising:

the cleaning device of claim 10; and a rotating charging body as the body to be cleaned.

13. An assembled body assembled so as to be attachable and detachable from an apparatus main body as a single unit, the assembled body comprising:

the cleaning device of claim 9;

a body to be charged; and a charging body that charges the body to be charged and rotates as the body to be cleaned.

14. An assembled body assembled so as to be attachable and detachable from an apparatus main body as a single unit, the assembled body comprising:

the cleaning device of claim 10;

a body to be charged; and a charging body that charges the body to be charged and rotates as the body to be cleaned.

15. An image forming apparatus comprising:

the cleaning device of claim 9;

an image holding body capable of holding an image;

a charging body that charges the image holding body and rotates as the body to be cleaned;

an exposing device that light-exposes the image holding body charged by the charging body, forming an electrostatic latent image; and a developing device that develops the electrostatic latent image formed on the image holding body by the exposing device.

16. An image forming apparatus comprising:

the cleaning device of claim 10;

an image holding body capable of holding an image;

a charging body that charges the image holding body and rotates as the body to be cleaned;

an exposing device that light-exposes the image holding body charged by the charging body, forming an electrostatic latent image; and a developing device that develops the electrostatic latent image formed on the image holding body by the exposing device.

17. The cleaning body of claim 1, wherein the held portion has a width smaller than a width of the elastic layer.

18. The cleaning body of claim 1, wherein the held portion has a projection that has a long thin triangular shape.

* * * * *